United States Patent [19]

Cusenza

[11] 4,249,549

[45] Feb. 10, 1981

[54] ROOT PERM ROD

[75] Inventor: John Cusenza, Tarzana, Calif.

[73] Assignee: Sebastian International Inc., Chatsworth, Calif.

[21] Appl. No.: 955,177

[22] Filed: Oct. 26, 1978

[51] Int. Cl.[3] ..... A45D 2/36

[52] U.S. Cl. ..... 132/36 C

[58] Field of Search ..... 132/40, 41, 42, 36 C

[56] References Cited

U.S. PATENT DOCUMENTS

| | | | |
|---|---|---|---|
| 2,210,897 | 8/1940 | Caldora | 132/36 C |
| 2,564,558 | 8/1951 | Berman et al. | 132/41 R |
| 2,748,779 | 6/1956 | Crothers | 132/40 X |
| 2,758,604 | 8/1956 | Graf | 132/41 R |
| 2,764,985 | 10/1956 | Papish | 132/41 R |
| 2,819,722 | 1/1958 | Spilo et al. | 132/40 X |
| 3,080,873 | 3/1963 | Feist | 132/42 R |
| 3,123,079 | 3/1964 | Buesgen | 132/40 |
| 3,141,463 | 7/1964 | Hatton | 132/42 R |
| 3,367,345 | 2/1968 | Riley | 132/7 |
| 3,960,156 | 6/1976 | Thompson | 132/42 R |

*Primary Examiner*—G. E. McNeill

*Attorney, Agent, or Firm*—Spensley, Horn, Jubas & Lubitz

[57] ABSTRACT

For use in a hair treatment procedure, an apparatus for protecting previously treated hair from retreatment while, at the same time, serving as a winding rod for the hair to be treated. The invention includes a curling rod upon which the hair section to be protected is wound. The curling rod and wound hair is then enclosed within a slotted, split cylindrical casing. Winding of the hair section to be treated continues around the casing, exposing this hair section to the treatment materials.

13 Claims, 3 Drawing Figures

ROOT PERM ROD

BACKGROUND OF THE INVENTION

1. Field of the Invention

The present invention relates to an apparatus for protecting previously treated hair from retreatment while, at the same time, serving as a winding rod for hair to be treated in a hair treatment procedure.

2. Prior Art

To acheive the best results in certain hair treatment procedures, it is important to segregate previously treated hair sections from those which are yet to be treated. The common permanent is a frequently used example of such a hair treatment procedure. Typically, the permanent is applied to hair consisting of a previously permanented section that has grown out from the scalp, and a new growth section, close to the scalp, which has surfaced since the previous treatment. Under present methods the hairdresser normally winds both sections of hair on a curling rod and applies the chemical solution thereon. The net effect is that the previously treated hair is over-processed, which damages the hair beyond repair and results in a dry, brittle texture. Correspondingly, the newly grown hair is barely waved.

Various hair curling devices have been suggested in the past for solving this problem. In U.S. Pat. No. 3,943,946 to Gallegos, the previously treated hair and a sheet of fluid impermeable material are wound together upon a plastic curling rod. A split sleeve of resilient polyethylene is then pressed onto the assembly of wound hair and sheet, thus sealing the wound hair from intrusion of the hair treatment materials. In this embodiment, the split sleeve acts in combination with the fluid impermeable sheet to protect the previously treated hair. The newly grown hair is then wound upon the split sleeve until the assembly is located adjacent to the scalp. An elastic cord is then stretched across the wound hair to retain it in position.

Another technique is shown in the U.S. Pat. No. 3,367,345 to Riley. There, the hair section to be protected is wrapped in a fluid impermeable paper. The enclosed hair and the paper are then rolled up into a croquignole. The unrolled exposed hair section is then treated with solution. This invention provides no means for winding the hair section to be treated.

In both of the referenced patents, protection of the previously treated hair is accomplished in large part by a fluid impermeable sheet. This requires the time consuming steps of placing the outstretched hair on the sheet, and then rolling the hair in combination with the sheet. This procedure is also extremely awkward for any person rolling their own hair, in that they have to keep the hair section and sheet in alignment with one hand, while manipulating the curling rod with the other.

It is an object of the present invention to provide protection for previously treated hair without the need of a fluid impermeable sheet. A further object of the inventive apparatus is to provide such protection while simultaneously serving as a winding rod upon which the remaining untreated hair sections can be wound.

BRIEF SUMMARY OF THE INVENTION

These and other objectives are acheived by providing a root perm rod that encapsulates previously treated hair, and at the same time serves as a winding rod for hair to be treated in a hair treatment procedure. To accomplish this, the apparatus includes a hair receiving spool or curling rod, a split cylindrical casing adapted to fold over and totally enclose the curling rod, and two caps, connected by an elastic band, adapted to fit over both ends of the cylindrical casing.

In a hair treatment procedure, the previously treated hair is preferably wound upon the curling rod. The curling rod and wound hair is then enclosed within the split cylindrical casing. A narrow slot in the side of the closed casing allows the curling rod to be totally encapsulated without pinching the unwound section of hair closest to the curling rod. The hair section to be treated, which lies closest to the scalp, is then wound upon the cylindrical casing. An elastic band, which is connected to caps placed on both ends of the cylindrical casing, retains the wound hair in place.

DETAILED DESCRIPTION

Figure 1:
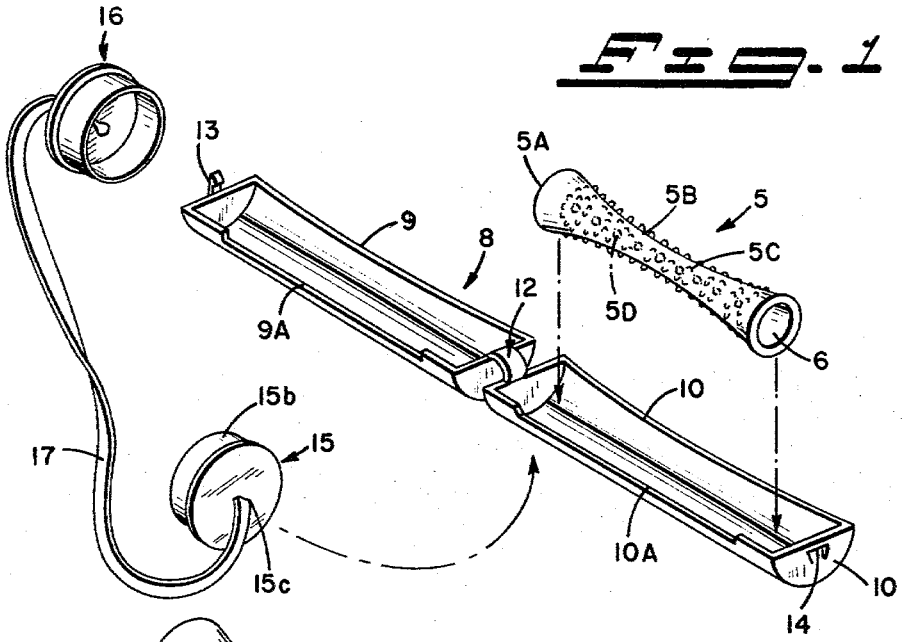
FIG. 1 is a perspective view of the elongated curling rod, bipartite cylindrical casing, and sealing caps of the present invention.

As shown in FIG. 1, the root perm rod of the present invention includes a curling rod 5, a split cylindrical casing 8, and two sealing caps 15 and 16 connected by an elastic retaining band 17. The cylindrical casing 8 is adapted to encapsulate and protect the curling rod 5 and hair wound thereon, while also serving as a winding member for the remaining hair section 21 (see FIG. 2) not encapsulated. The sealing caps 15 and 16 and elastic band 17 retain the hair section 21 wound upon the cylindrical casing 8.

The curling rod 5 is an element of generally conventional design upon which a hair section can be wound. The curling rod 5 illustrated is essentially an elongated hyperboloidal spool made of a molded plastic composition. The curling rod 5 has a larger diameter at its end portions **5*a* than the diameter of the central portion 5*b*, resulting in a generally concave shape of the central portion 5*b*. This shape facilitates winding of a hair section 20 (see FIG. 2) around the curler central portion 5*b* only, enabling the end portions 5*a*, upon, which no hair is accmulated, to be used for winding the curling rod 5**.

The curling rod 5 uses a plurality of minute teeth **5*c* to form a rough surface that serves to grip the hair 20 being wound upon the curler 5. The rod 5 also has hollow core 6. The hollow core 6 allows for circulation of drying air through dampened hair 20 wound upon the rod 5. Additional circulation may be provided by adding small perforations 5*d* that open into the hollow core 6**.

The outer casing or curling rod shell 8 includes two hollowed half shells 9 and 10. Preferably, these half shells are arranged in tandem and are coupled at their common end by a flexible hinge 12. In the alternative the half shells may be coupled by a flexible longitudinal hinge so that they are side-opening. Each casing half shell is generally semi-cylindrical in shape, with the end portions having a larger diameter than the central portion. Thus, when closed, the casing 8 has a generally cylindrical shape with a concave central section 8*a* to conform to the shape of the enclosed curling rod 5 (see FIG. 2). Recesses, 9*a* and 10*a*, are located on the side of each half shell section, 9 and 10 respectively, such that when the casing 8 is closed it contains a slot 11 (see FIG. 3) through which unwound hair 21 may pass in a layer of relatively uniform thickness, as shown.

Figure 2:
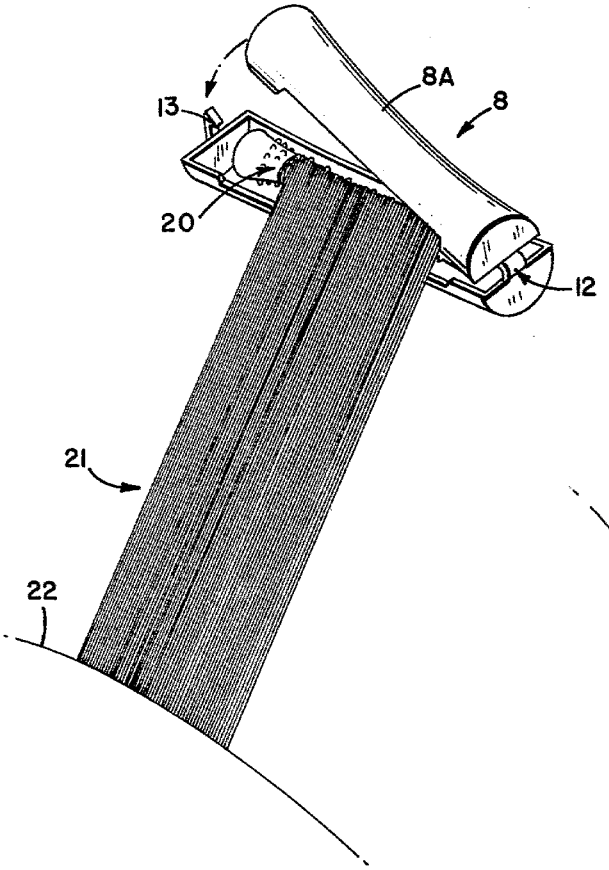
FIG. 2 is a perspective view of the present invention illustrating placement of the wound, previously treated hair and the elongated curling rod within the cylindrical casing.
Figure 3:
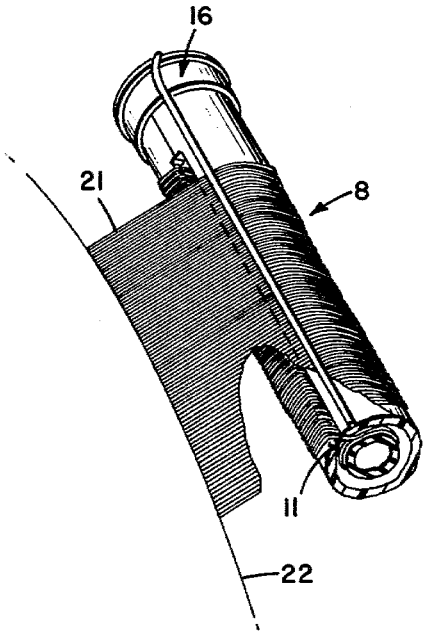
FIG. 3 is a perspective cutaway view, partly in section, showing the assembled elements of the present invention. The hair to be treated is wound and retained upon the cylindrical casing.

As shown in FIG. 2 the plastic, resilient hinge 12 enables the two half shells 9 and 10 to be opened away from each other, allowing for ease of insertion of the curling rod 5. The hinge 12 then permits the two half shells 9 and 10 to be folded one over the other, thereby totally enclosing the curling rod 5 located within. The casing 8 is latched or locked around the curling rod 5 by virtue of an upstanding catch 13 on the distal end of one of the half shell sections that is accepted into a corresponding notch 14 in the distal end of the other half shell section. As shown in FIG. 3, when the casing or shell 8 is closed, the recesses 9*a* and 10*a* in each half shell section 9 and 10 create a narrow slot 11. The slot 11 width is sufficiently small so that the closed casing 8 forms a fluid tight seal around the unwound hair that protrudes in a layer through the slot 11. This keeps the treatment fluid out of the interior of the casing 8, thereby eliminating the need for a fluid impermeable sheet.

Two sealing caps 15 and 16 are adapted to fit on the end portions of the closed casing 8. Each cap is essentially a short cylindrical tube with a hollowed cylindrical section 15*b* having an inner diameter essentially equal to the outer diameter of the end portions of the casing 8. The cap cylindrical section 15*b* stands perpendicularly out from a flat cylindrical end 15*a* having a diameter slightly greater than the diameter of the cylindrical section 15*b*. The cap end 15*a* contains a small opening 15*c* through which an elastic band 17 passes, interconnecting the two caps 15 and 16. The caps 15 and 16 act to seal the closed cylindrical casing 8 and stretch the elastic band 17 over the casing 8 and any hair section wound thereon.

The preferred use of the present invention is shown in FIGS. 2 and 3. For purposes of this description, the hair has been divided into two sections, a previously treated section 20, and a newly grown untreated section 21 that lies closest to the scalp 22. The previously treated hair 20 is first rolled upon the elongated curling rod 5. The curling rod 5 and wound hair 20 is then placed within one of the half shells 9 or 10 of the split casing 8, being careful to situate the unwound hair section 21 within the half shell recess 9*a* or 10*a*. The casing half shells, situated in tandem or alternatively side-by-side, are then folded over and latched, totally encapsulating the curling rod 5 and wound hair section 20. The slot 11 created by the recesses 9*a* and 10*a* forms a fluid tight seal around the unwound hair section protruding in a layer therethrough. This protects the encased hair section 20 from hair treatment materials without the need of a fluid impermeable sheet.

Winding of the hair section to be treated 21 is then continued upon the cylindrical casing 8 until the entire hair section is rolled and the outer casing is in close proximity with the scalp 22. The sealing caps 15 and 16 are then placed at both ends of the cylindrical casing 8 which stretches the elastic band 17 over the casing 8 and wound hair section 21. This serves to retain the wound hair section 21 in place for the hair treatment procedure. In this configuration only the newly grown hair section to be treated 21 is exposed to the hair treatment materials.

While a preferred embodiment of the present invention has been described herein, it should be clear that the disclosed invention maybe be modified in many respects while still retaining its essential features and advantages. Accordingly, the scope of the invention is defined, not by the disclosed embodiment, but rather by the following claims.

What is claimed is:

1. An apparatus for protecting from fluid treatment the end section of a length of hair comprising:

casing means for enclosing and isolating from fluid treatment said end section to be protected;

slot means located in said casing means for allowing a length of hair to pass in a layer from the inside of said casing means to the outside of said casing means;

sealing means for isolating from fluid treatment said end section to be protected from a section of the same length of hair located outside said casing means whereby said casing, slot, and sealing means cooperate to protect the end section of a length of hair located within the casing means from exposure to fluid treatment applied to hair external to the casing means.

2. An apparatus according to claim 1 wherein said casing means is a fluid impervious cylinder.

3. An apparatus according to claim 2 wherein said fluid impervious cylinder comprises:

two semi-cylindrical hollowed sections; and securing means for uniting the said semi-cylindrical sections when they are positioned so as to form the fluid impervious cylinder;

said slot means being located along the length of said fluid impervious cylinder between the two semi-cylindrical hollowed sections.

4. An apparatus according to claim 3 further comprising a generally hyperboloidal hair receiving spool of a size and shape to be received inside said fluid impervious cylinder, whereby the section of a length of hair enclosed by the fluid impervious cylinder can be wound in layers on the spool.

5. An apparatus according to claim 3 wherein the securing means for uniting said semi-cylindrical sections comprises:

at least one upstanding catch affixed to one of said semi-cylindrical sections, and at least one corresponding notch in the other of said sections, the catch and notch being shaped and located to interfit with one another and hold the semi-cylindrical sections together.

6. An apparatus according to claim 2 further comprising:

hair retaining means for holding to the cylinder a hair section wound in layers around the cylinder, said cylinder thereby acting as a hair receiving spool.

7. An apparatus according to claim 6 wherein said hair retaining means includes two caps and an elastic member extending between the two caps, said caps adapted to fit upon the ends of said fluid impervious cylinder, whereby the said elastic member may be stretched over the hair section wound in layers around the fluid impervious cylinder and retain the hair section in place upon the fluid impervious cylinder.

8. An apparatus according to claim 7 wherein said caps are shaped and sized to form a fluid tight sealing arrangement around the ends of the said fluid impervious cylinder.

9. An apparatus according to claim 8 wherein the said fluid impervious cylinder comprises:

two semi-cylindrical hollowed sections; and securing means for securely uniting the said semi-cylindrical sections when they are positioned so as to form the fluid impervious cylinder;

said slot means being located along the length of the said fluid impervious cylinder between the two semi-cylindrical hollowed sections.

10. An apparatus according to claim 9 wherein:

said apparatus further comprises a generally hyperboloidal hair receiving spool of a size and shape to be received inside said fluid impervious cylinder, whereby the section of a length of hair enclosed by the fluid impervious cylinder casing can be wound in layers on the spool, and wherein the securing means for uniting the said semi-cylindrical sections comprises:

at least one upstanding catch affixed to one of said semi-cylindrical sections, and at least one corresponding notch in the other of said sections, the catch and notch being shaped and located to interfit with one another and hold the semi-cylindrical sections together.

11. A method for protecting from fluid treatment the end section of a length of hair during a hair treatment procedure, the method comprising:

removably enclosing and sealing the hair section to be protected from fluid treatment in a casing impervious to the treatment; and treating the unenclosed section of the length of hair with a fluid.

12. A method according to claim 11 further comprising:

winding the section of the length of hair to be protected from treatment in layers around a spool; and enclosing the spool within the fluid impervious casing.

13. A method according to claim 12 further comprising:

winding at least a portion of the unenclosed section of the length of hair in layers around said fluid impervious casing; and retaining said wound portion of the length of hair in place about said fluid impervious casing during treatment.

* * * * *